US010605544B2

(12) United States Patent
Zaffetti et al.

(10) Patent No.: US 10,605,544 B2
(45) Date of Patent: Mar. 31, 2020

(54) HEAT EXCHANGER WITH INTERLEAVED PASSAGES

(71) Applicant: HAMILTON SUNDSTRAND CORPORATION, Charlotte, NC (US)

(72) Inventors: Mark A. Zaffetti, Suffield, CT (US); Jeremy M. Strange, Windsor, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 819 days.

(21) Appl. No.: 15/205,081

(22) Filed: Jul. 8, 2016

(65) Prior Publication Data

US 2018/0010864 A1 Jan. 11, 2018

(51) Int. Cl.

| | |
|---|---|
| ***F28F 3/02*** | (2006.01) |
| ***F28D 9/00*** | (2006.01) |
| ***F28F 13/08*** | (2006.01) |
| ***F28F 9/02*** | (2006.01) |

(52) U.S. Cl.

CPC ..... *F28F 3/02* (2013.01); *F28D 9/005* (2013.01); *F28D 9/0093* (2013.01); *F28F 9/02* (2013.01); *F28F 13/08* (2013.01)

(58) Field of Classification Search

CPC ..... F28F 3/02; F28F 13/08; F28F 7/02; F28F 1/006; F28D 9/005; F28D 9/0093; F28D 9/02

USPC ..... 165/146, 147, 164

See application file for complete search history.

(56) References Cited

U.S. PATENT DOCUMENTS 1,571,068 A * 1/1926 Stancliffe ..... F28D 7/0025 122/32
2,401,797 A * 6/1946 Rasmussen ..... F28F 13/003 165/164
3,272,260 A * 9/1966 Raub et al. ..... F28F 7/02 165/164

(Continued)

FOREIGN PATENT DOCUMENTS

EP 2789962 A1 10/2014
WO 9215830 A1 9/1992
WO 2016057443 4/2016

OTHER PUBLICATIONS

Partial European Search Report for European Application No. 17180201.0 dated Nov. 27, 2017.

(Continued)

*Primary Examiner* — Travis C Ruby

(74) *Attorney, Agent, or Firm* — Carlson, Gaskey & Olds, P.C.

(57) ABSTRACT

A heat exchanger includes first fluid passages that each have a first inlet that communicates into a first core passage and then a first outlet. The first inlet has a first inlet cross-sectional perimeter. The first core passage has a first core cross-sectional perimeter. Second fluid passages are interleaved with the first fluid passages. Each of the second passages have a second inlet that communicates into a second core passage and then a second outlet. The second inlet has a second inlet cross-sectional perimeter. The second core passage has a second core cross-sectional perimeter. The first and second core cross-sectional perimeters are larger than their respective first and second inlet cross-sectional perimeters. The first and second core passages are undivided from their respective first and second inlets to their respective first and second outlets.

11 Claims, 8 Drawing Sheets

(56) References Cited

U.S. PATENT DOCUMENTS

| | | | | |
|---|---|---|---|---|
| 4,149,591 | A * | 4/1979 | Albertsen | F28F 7/02 165/165 |
| 4,546,827 | A * | 10/1985 | Wachendorfer, Sr. | F28F 7/02 165/146 |
| 5,725,051 | A * | 3/1998 | Veltkamp | F28F 21/06 165/164 |
| 9,134,072 | B2 | 9/2015 | Roisin et al. | |
| 2001/0030043 | A1 | 10/2001 | Gleisle et al. | |
| 2004/0261379 | A1* | 12/2004 | Bruun et al. | F23C 13/00 55/418 |
| 2014/0340845 | A1 | 11/2014 | Straznicky et al. | |
| 2016/0054071 | A1* | 2/2016 | Cordova et al. | F02C 7/08 165/164 |
| 2016/0131443 | A1* | 5/2016 | Oliva et al. | F28F 7/02 165/164 |

OTHER PUBLICATIONS

Extended European Search Report for European Application No. 17180201.0 dated Mar. 1, 2018.

* cited by examiner

HEAT EXCHANGER WITH INTERLEAVED PASSAGES

BACKGROUND

This application relates to a heat exchanger having a unique arrangement of flow passages.

Heat exchangers are utilized in various applications and typically cool one fluid by exchanging heat with a secondary fluid. In one type of arrangement, heat is exchanged between the fluids across a shared wall separating adjacent hot and cold passages. Traditionally, these have had equal and constant cross-sections along the length of the heat exchanger.

There have been proposals to create heat exchangers with hot and cold passages using additive manufacturing such that their cross-sectional size decrease as the passages are divided further downstream. Such branching can increase pressure drop in the passages and reduce effective heat transfer length. The feasibility of manufacturing such heat exchangers has been limited by the state of additive manufacturing technology.

The branched hot and cold passages are interleaved with one another and include circular cross-sections through the passages. The walls separating the adjacent circular passages vary substantially in thickness, which reduces heat transfer effectiveness between the hot and cold passages.

The above features can contribute to losses in cooling efficiency.

SUMMARY

In one exemplary embodiment, a heat exchanger includes first fluid passages that each have a first inlet that communicates into a first core passage and then a first outlet. The first inlet has a first inlet cross-sectional perimeter. The first core passage has a first core cross-sectional perimeter. Second fluid passages are interleaved with the first fluid passages. Each of the second passages have a second inlet that communicates into a second core passage and then a second outlet. The second inlet has a second inlet cross-sectional perimeter. The second core passage has a second core cross-sectional perimeter. The first and second core cross-sectional perimeters are larger than their respective first and second inlet cross-sectional perimeters. The first and second core passages are undivided from their respective first and second inlets to their respective first and second outlets.

In a further embodiment of any of the above, first inlet manifolds communicated into the first inlets and first outlet manifolds communicated into by the second outlets. Second inlet manifolds communicated into the second inlets and second outlet manifolds communicated into by the second outlets. The first inlet manifolds, first outlet manifolds, second inlet manifolds, and second outlet manifolds extend in a first direction. The first fluid passages and second fluid passages extend in a second direction transverse to the first direction.

In a further embodiment of any of the above, a wall separates adjacent first and second core passages. The wall has a generally uniform thickness.

In a further embodiment of any of the above, the first core passages have a polygonal cross sectional shape with a flat. The flats of adjacent first fluid passages provide the wall.

In a further embodiment of any of the above, the first and second core passages are undivided from their respective first and second inlets to their respective first and second outlets.

In a further embodiment of any of the above, the first and second fluid passages are respectively configured to carry first and second fluids that have different properties from one another.

In a further embodiment of any of the above, the first fluid has a pressure in the first core passage that is less than a pressure of the first fluid at the first inlet.

In a further embodiment of any of the above, each first inlet has a first inlet cross-sectional area and each first core passage has a first core cross-sectional area. The first core cross-sectional areas are smaller than their respective first inlet cross-sectional area.

In a further embodiment of any of the above, an additively manufactured structure provides the first and second inlet and outlet manifolds and the first and second passages.

In a further embodiment of any of the above, a first fluid has a pressure in the first core passage that is less than a pressure of the first fluid at the first inlet.

In another exemplary embodiment, a heat exchanger includes first and second inlet and outlet manifolds that extend in a first direction. First fluid passages extend in a second direction transverse to the first direction and fluidly interconnect the first inlet and outlet manifolds. Each of the first fluid passages have a first inlet at the first inlet manifold that communicates into a first core passage, and then a first outlet at the first outlet manifold. The first inlet has a first inlet cross-sectional perimeter. The first core passage has a first core cross-sectional perimeter. Second fluid passages extend in the second direction transverse and fluidly interconnect the second inlet and outlet manifolds. The second fluid passages interleaved with the first fluid passages. Each of the second passages have a second inlet at the second inlet manifold that communicates into a second core passage, and then a second outlet at the second outlet manifold. The second inlet has a second inlet cross-sectional perimeter. The second core passage has a second core cross-sectional perimeter. The first and second core passages are undivided from their respective first and second inlets to their respective first and second outlets.

In a further embodiment of any of the above, a wall separates adjacent first and second core passages. The wall has a generally uniform thickness.

In a further embodiment of any of the above, the first core passages have a polygonal cross sectional shape with a flat. The flats of adjacent first fluid passages provide the wall.

In a further embodiment of any of the above, the first and second core passages are undivided from their respective first and second inlets to their respective first and second outlets.

In another exemplary embodiment, a heat exchanger includes first and second inlet and outlet manifolds that extend in a first direction. First fluid passages extend in a second direction transverse to the first direction and fluidly interconnect the first inlet and outlet manifolds. Each of the first fluid passages have a first inlet at the first inlet manifold that communicates into a first core passage, and then a first outlet at the first outlet manifold. The first inlet has a first inlet cross-sectional perimeter. The first core passage has a first core cross-sectional perimeter. Second fluid passages extend in the second direction transverse and fluidly interconnect the second inlet and outlet manifolds. The second fluid passages interleaved with the first fluid passages. Each of the second passages have a second inlet at the second inlet manifold that communicates into a second core passage, and then a second outlet at the second outlet manifold. The second inlet has a second inlet cross-sectional perimeter. The second core passage has a second core cross-sectional perimeter. The first and second core cross-sectional perimeters are larger than their respective first and second inlet cross-sectional perimeters.

In a further embodiment of any of the above, each first inlet has a first inlet cross-sectional area and each first core passage has a first core cross-sectional area. The first core cross-sectional areas are smaller than their respective first inlet cross-sectional area.

In a further embodiment of any of the above, a wall separates adjacent first and second core passages. The wall has a generally uniform thickness.

In a further embodiment of any of the above, the first core passages have a polygonal cross sectional shape with a flat. The flats of adjacent first fluid passages provide the wall.

In a further embodiment of any of the above, a method of manufacturing a heat exchanger comprising the step of building up with a plurality of layers a structure having a wall separating adjacent first and second core passages. The wall has a generally uniform thickness.

In a further embodiment of any of the above, the first and second directions are generally normal to one another.

DETAILED DESCRIPTION

FIGS. 1A through 7 show a heat exchanger 2 that transfers heat between two fluids in the example configuration using two groups of fluid passages. It should be understood that more than two groups of fluid passages can be provided in the heat exchanger to transfer heat between more than two fluids if desired.

The heat exchanger 2 may be additively manufactured, which would facilitate a more complex arrangement of fluid passages with more intricate features than a conventional tube and fin heat exchanger, for example. The heat exchanger 2 has alternating hot and cold fluid core passages between inlet and outlet manifolds. The core passages are very wide with respect to their height to provide a large heat transfer surface, which promotes greater heat transfer in one direction across the alternating core passages. Walls between the core passages are generally uniformly thin across the width of the example passages, which provides desired heat transfer across the entire width of the core passages. The flow paths through the disclosed heat exchanger 2 do not branch in between the inlet and outlet manifolds and thereby avoid increases in pressure drop as well as increasing effective heat transfer length. In this way, the disclosed heat exchanger 2 achieves high heat transfer efficiency in a compact construction.

Figure 1A:
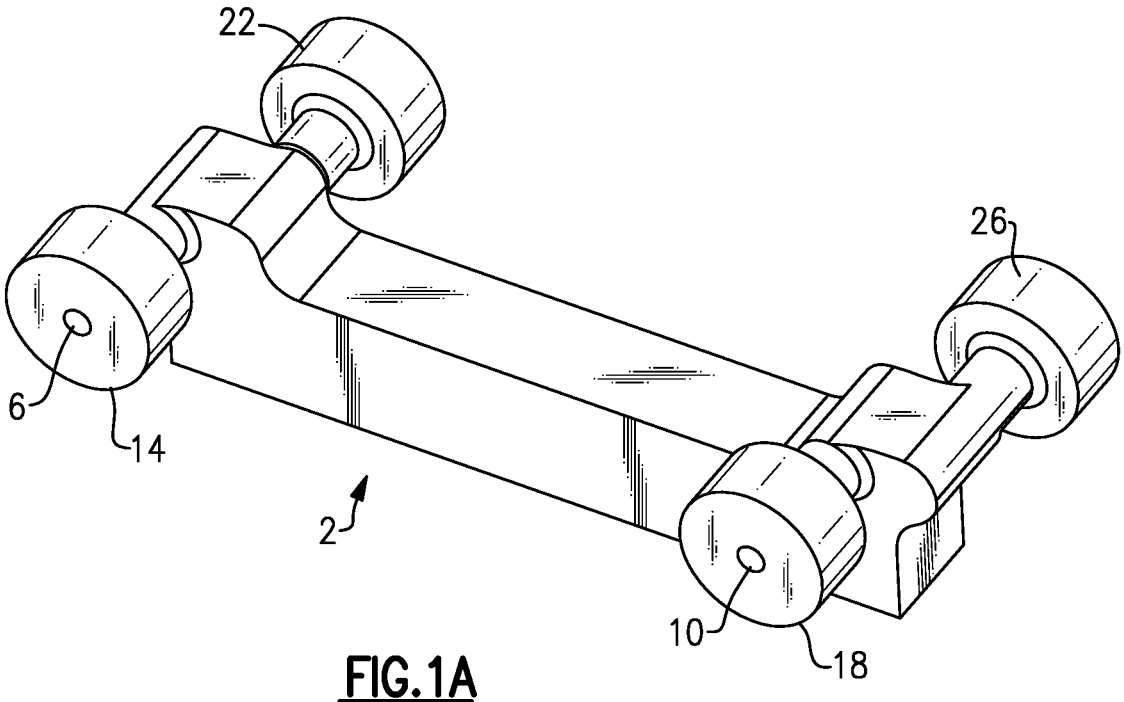
FIG. 1A shows an isometric view of a heat exchanger.
Figure 1B:
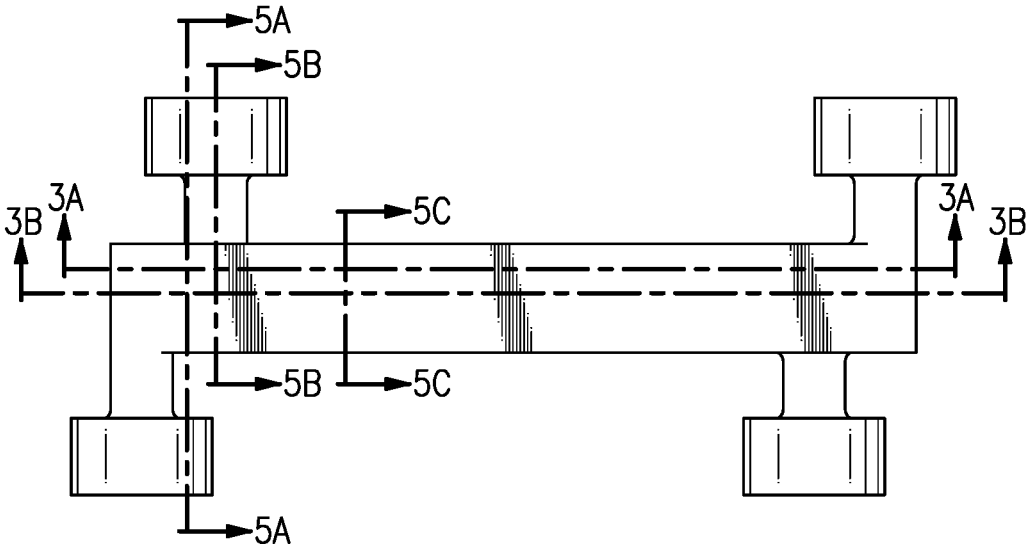
FIG. 1B shows a top view of a heat exchanger shown in FIG. 1A.
Figure 1C:
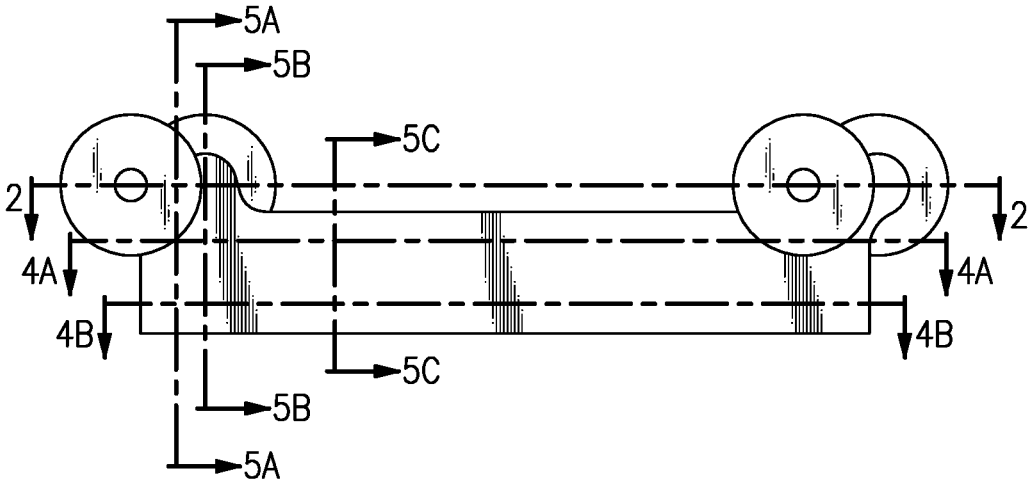
FIG. 1C shows a side view of the heat exchanger shown in FIG. 1A.
Figure 1D:
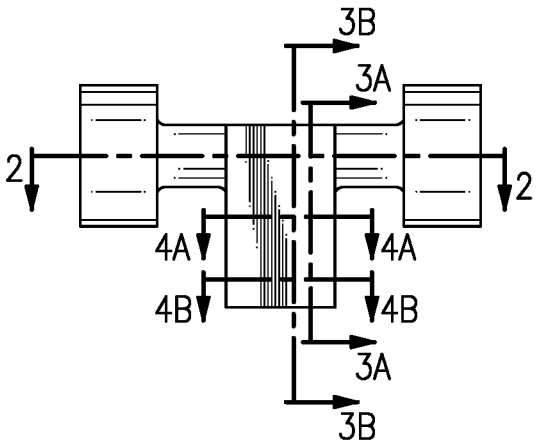
FIG. 1D shows a front view of the heat exchanger shown in FIG. 1A.

Referring to FIG. 1A, the heat exchanger 2 has a hot inlet socket 14 that is fluidly connected to a hot outlet socket 18. Similarly, a cold inlet socket 22 is fluidly connected to a cold outlet socket 26. The sockets provide structure that is used to connect the heat exchanger 2 to other components, such as fluid conduits. It should be understood that the heat exchanger 2 may use different or additional features to provide connections to other structures.

Figure 2:
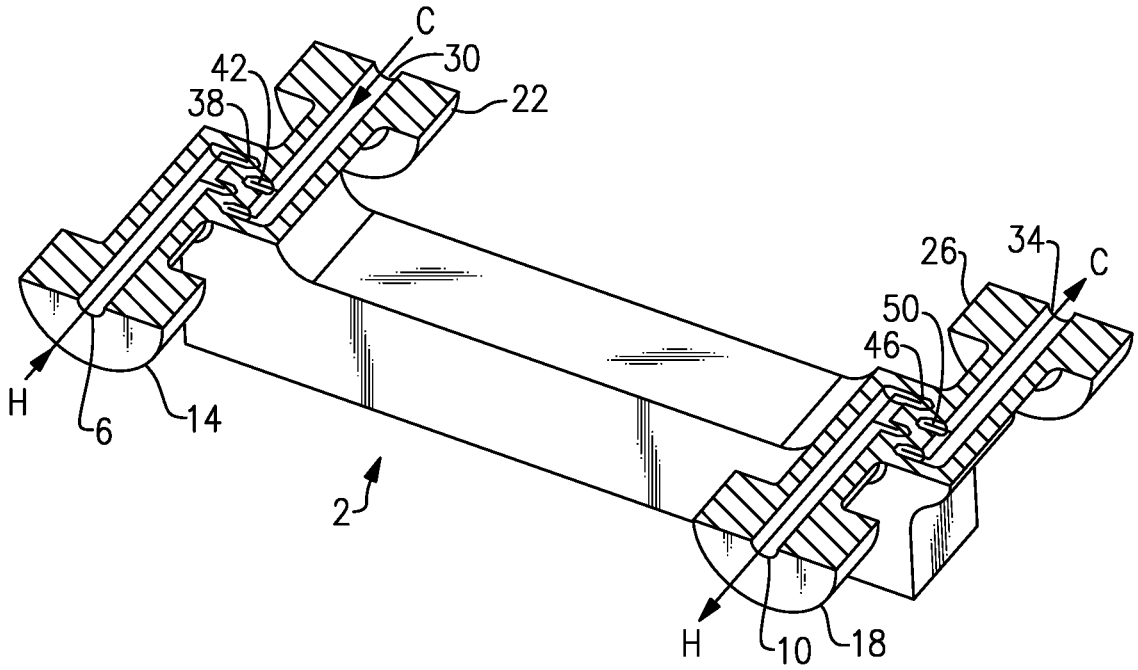
FIG. 2 is a view along line 2-2 of FIGS. 1C and 1D.

As shown in FIG. 2, a hot inlet channel 6 communicates into multiple hot inlet manifolds 38, and the cold inlet channel 30 communicates into multiple cold inlet manifolds 42. Multiple hot outlet manifolds 46 communicate into the hot outlet channel 10, and multiple cold outlet manifolds 50 communicate into the cold outlet channel 34.

Figure 3A:
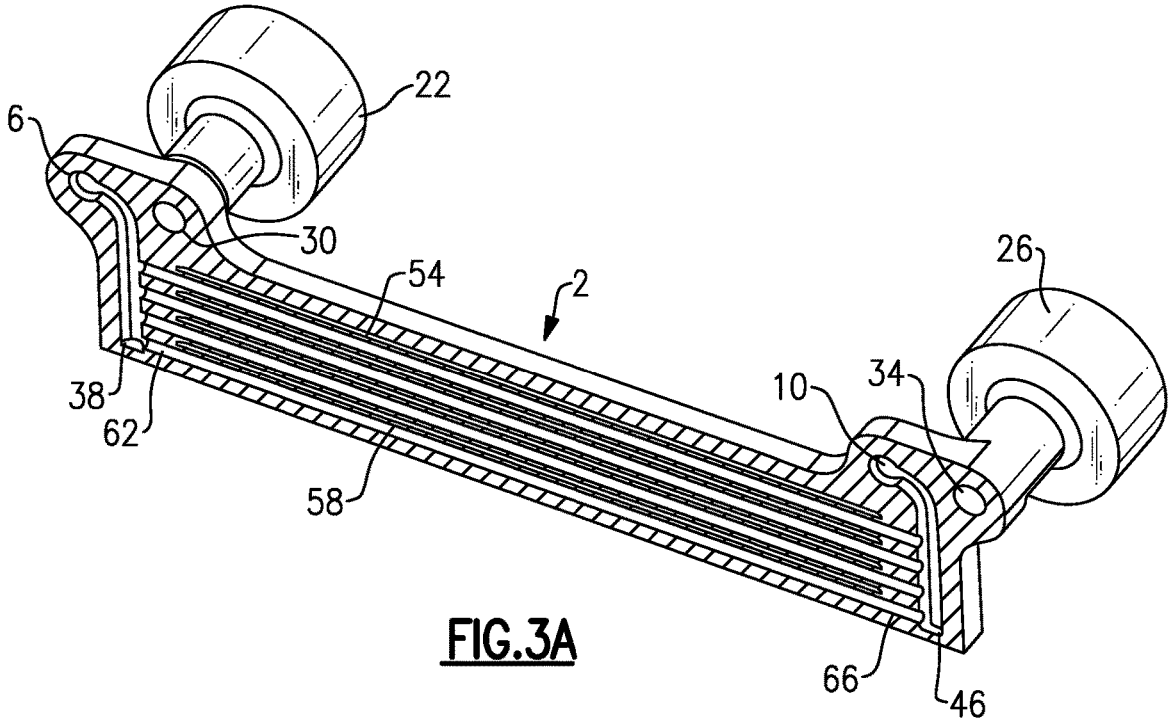
FIG. 3A is a view along line 3A-3A of FIGS. 1B and 1D.
Figure 3B:
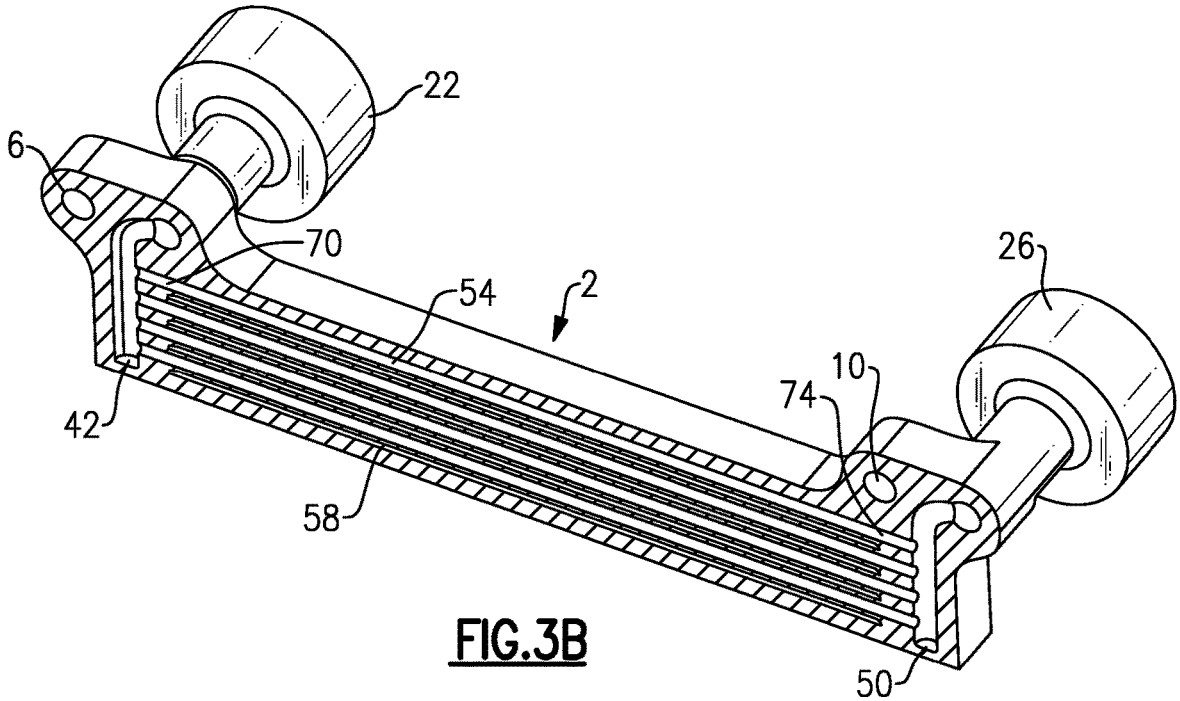
FIG. 3B is a view along line 3B-3B of FIGS. 1B and 1D.

Referring to FIGS. 3A and 3B, a hot inlet manifold 38 of the heat exchanger 2 communicates into multiple hot inlets 62. The hot inlets 62 each communicate into hot core passages 58, which terminate into hot outlets 66 provided at the hot outlet manifold 46. The hot core passages 58 are interspersed with cold core passages 54 in an alternating, adjacent relationship. The manifolds 38, 42, 46, 50 extend in a first direction, which also corresponds the direction in which the greatest amount of heat transfer occurs between the core passages due to their geometry. The core passages 54, 58 extend in a second direction that is normal to the first direction in the example.

The cold inlet manifold 42 provides multiple cold inlets 70. The cold inlets 70 communicate into the cold core passages 54, which communicate into cold outlets 74 that terminates at the cold outlet manifold 50.

The core passages provide the region in which the bulk of the heat transfer between the fluids takes place. As can be appreciated from the disclosed example in FIGS. 2 through 3B, this configuration allows the hot core passages 58 and cold core passages 54 to be interleaved to such an extent that no hot core passage 58 is adjacent to another hot core passage 58, nor is any cold core passage 54 adjacent to another cold core passage 54. The hot fluid flow H and cold fluid flow C is split only twice from each channel to the pair of manifolds. It should be understood that fewer or greater splits can be provided from the channels depending upon the heat exchanger application. However, once the fluid flows into the core passages, the fluid remains undivided within each core passage such that there is no branching of the core passages. This low number of splits and undivided core passage flow achieves low resistance in the heat exchanger 2.

Figure 4A:
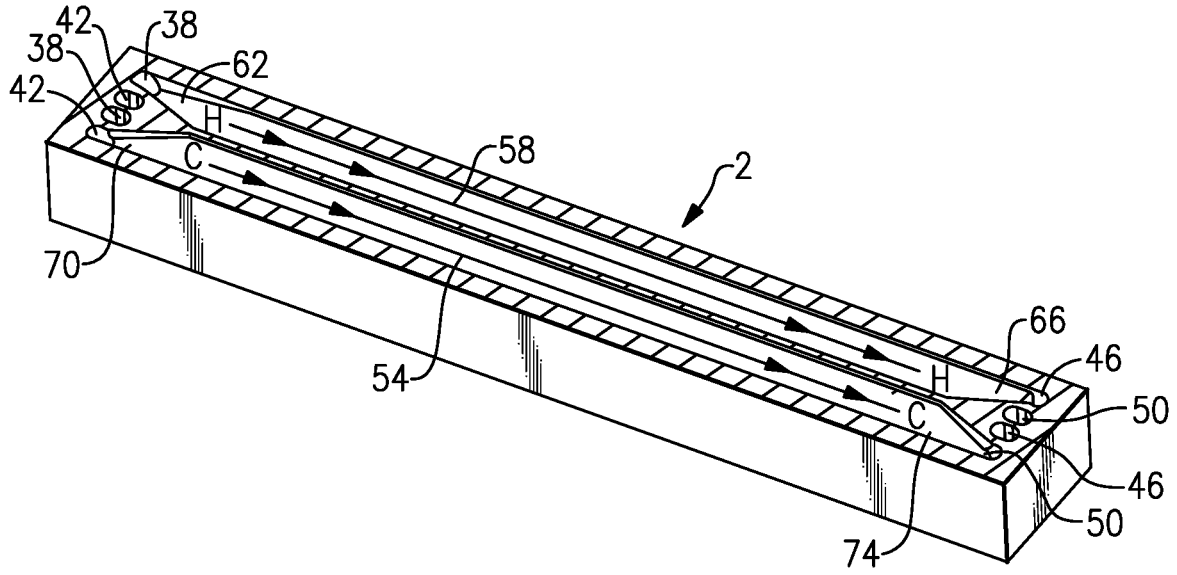
FIG. 4A is a view along line 4A-4A of FIGS. 1C and 1D.
Figure 4B:
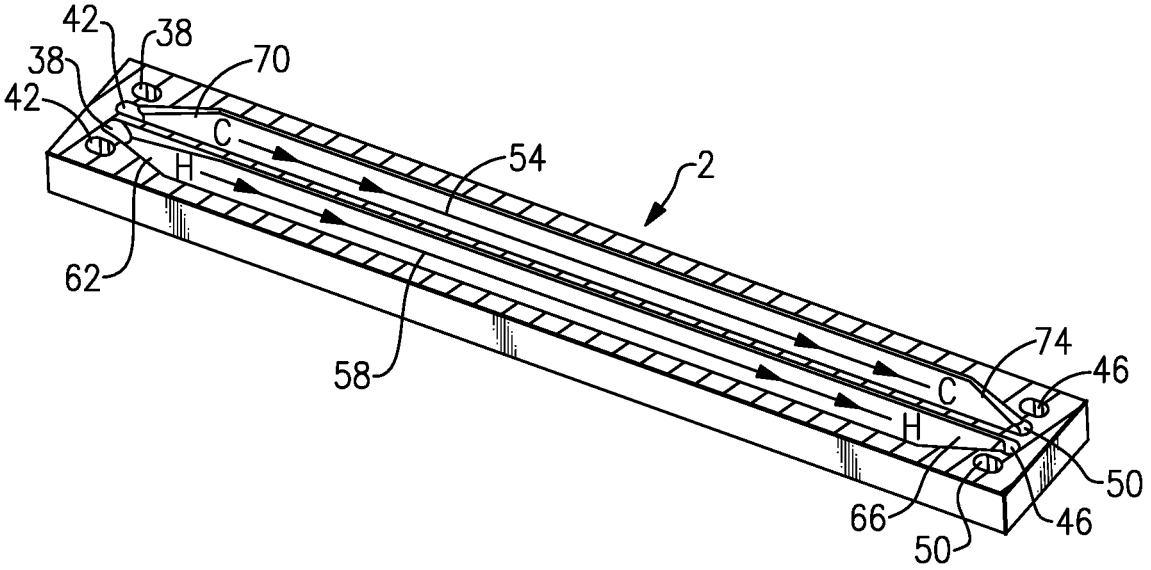
FIG. 4B is a view along line 4B-4B of FIGS. 1C and 1D.

Referring to FIGS. 4A and 4B, a hot fluid flow H enters through a hot inlet manifold 38 and flows from hot inlet 62 through hot core passage 58 to hot outlet 66, then exits through a hot outlet manifold 46. A cold fluid flow C enters through a cold inlet manifold 42 and flows from cold inlet 70 through cold core passage 54 to cold outlet 74, then exits through a cold outlet manifold 50. It should be appreciated that though the hot fluid flow H and cold fluid flow C are shown in FIGS. 4A and 4B to flow in the same direction, they may flow in different directions without departing from the scope of this invention. In one example, the hot flow H and cold flow C may flow in parallel, but opposite directions. In another example, some of the hot core passages 58 may carry part of the hot flow H in a direction transverse to or even perpendicular to the direction that some of the cold core passages 54 carry the cold flow C.

Figure 5A:
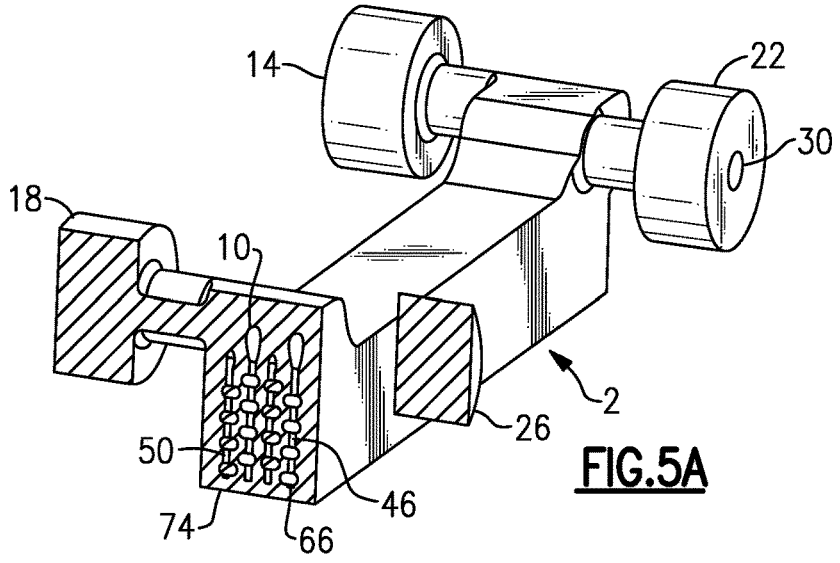
FIG. 5A is a view along line 5A-5A of FIGS. 1B and 1C.
Figure 5B:
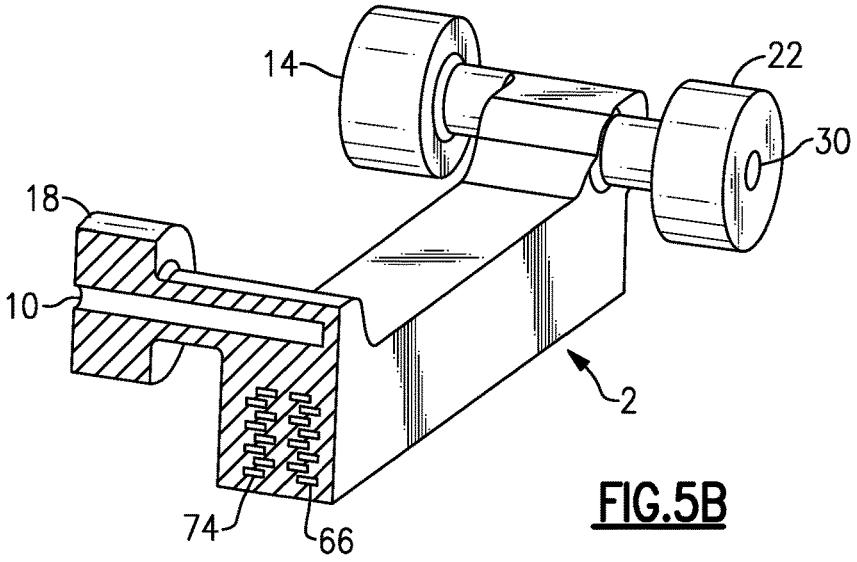
FIG. 5B is a view along line 5B-5B of FIGS. 1B and 1C.
Figure 5C:
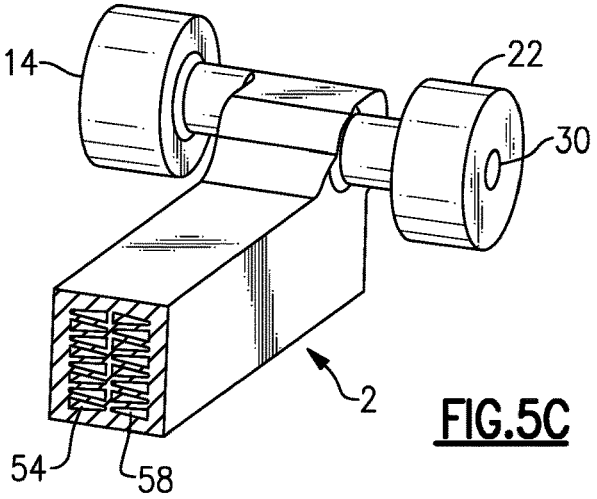
FIG. 5C is a view along line 5C-5C of FIGS. 1B and 1C.

The hot and cold inlets 62, 70 gradually decrease in cross-sectional area while gradually increasing in cross-sectional perimeter until the inlets reach their respective core passage 58, 54, as shown in FIGS. 5A, 5B, and 5C. The hot and cold core passages 58, 54 have a uniform cross-section until they reach their respective hot and cold outlets 66, 74, which then gradually increase in cross-sectional area while gradually decreasing in cross-sectional perimeter. As shown in FIG. 5C, the cold core passage 54 and the hot core passage 58 are arranged adjacent to each other so that thinnest portions of the nearby core passage adjoin one another in one direction. The widest portions of the core passages are arranged next to one another in a perpendicular direction along which the greatest amount of heat transfer occurs.

The hot core passages 58 and cold core passages 54 may be packed closely together along the width and height of the heat exchanger 2. It should be understood that a heat exchanger could include a greater number of hot core passages 58 and cold core passages 54, or a greater number of hot inlet manifolds 38 and cold inlet manifolds 42 according to the pattern described above without departing from the scope of the invention. In this way, the size of the heat exchanger may be adjusted to the application. However, heat transfer may be much greater in the height direction than the width direction in this embodiment because this interleaved structure provides hot and cold core passages 58 and 54 that are wide, but not tall. This provides greater shared surface area between hot and cold core passages 58 and 54 that are adjacent height-wise than widthwise. It should be understood that the terms height and width are used for illustrative purposes. The heat exchanger 2 could be embodied in other orientations without departing from the scope of this invention.

FIGS. 6A-6E illustrate the transition from the hot inlet 62 to the hot core passage 58. The transitions from the cold inlet 70 to the cold core passage 54 is similar, as is the transition from the core passages to their outlets.

Figure 6A:
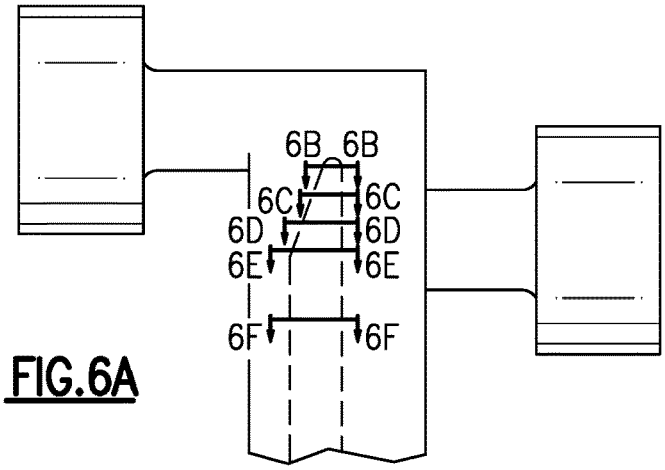
FIG. 6A is a top down view of a portion of the heat exchanger shown in FIG. 1A.
Figure 6B:
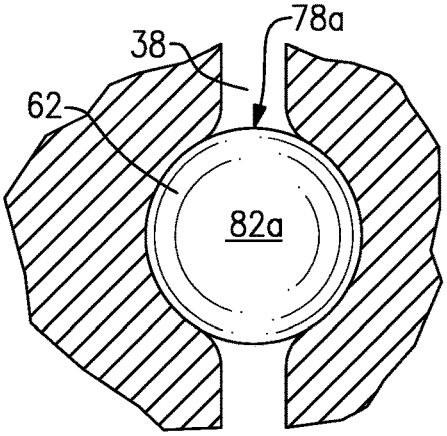
FIG. 6B is a view along line 6B-6B of FIG. 6A.
Figure 6C:
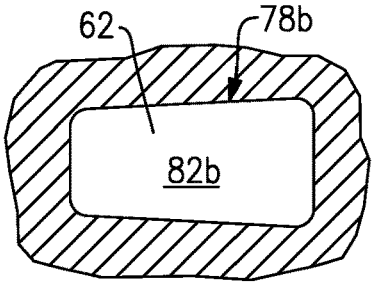
FIG. 6C is a view along line 6C-6C of FIG. 6A.
Figure 6D:
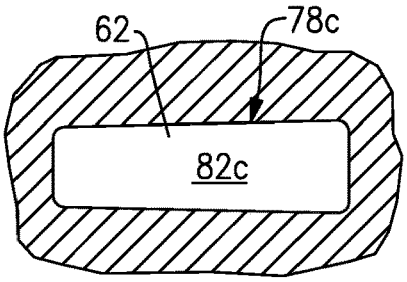
FIG. 6D is a view along line 6D-6D of FIG. 6A.
Figure 6E:
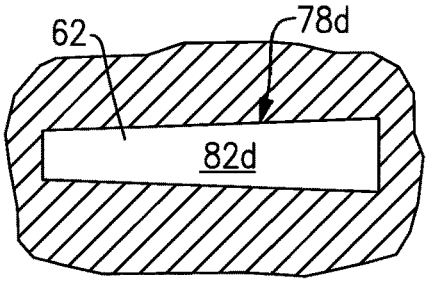
FIG. 6E is a view along line 6E-6E of FIG. 6A.
Figure 6F:
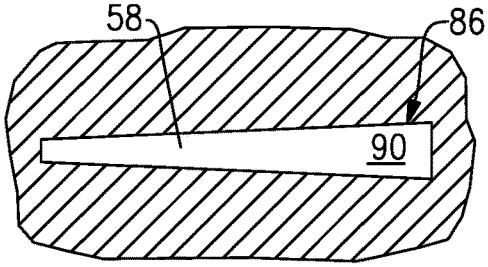
FIG. 6F is a view along line 6F-6F of FIG. 6A.
Figure 7:
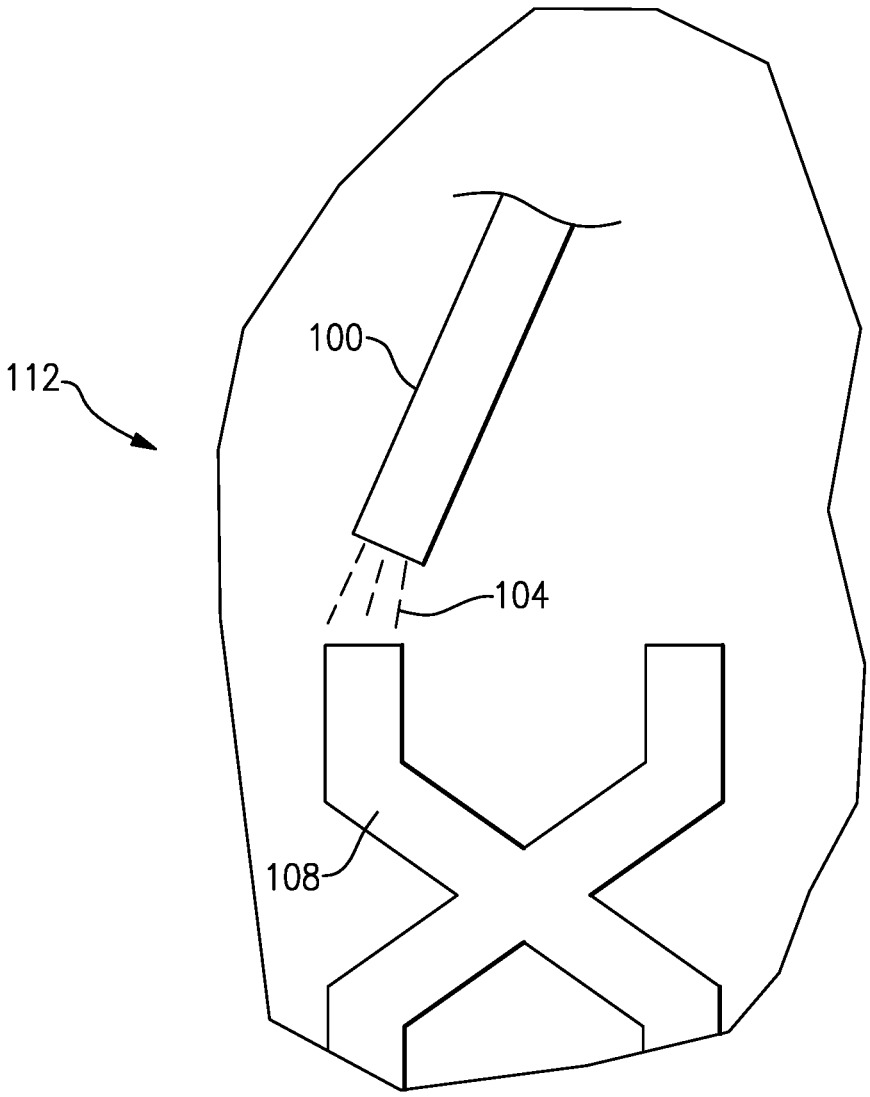
FIG. 7 schematically shows the formation of a portion of the heat exchanger shown in FIG. 1A utilizing a disclosed method.

FIG. 6B shows the hot inlet 62 having a round cross-sectional area 82*b* and a cross-sectional perimeter 78*a*. FIG. 6F shows the hot core passage 58 having a cross-sectional area 90 with a trapezoidal shape having a cross-sectional perimeter 86. The hot core cross-sectional perimeter 86 is larger than the hot inlet cross-sectional perimeter 78*b*, but the hot core cross-sectional area 90 is smaller than the hot inlet cross-sectional area 82*b*. The cross-sectional areas 82*b*, 82*c*, 82*d*, 82*e* and cross-sectional perimeters 78*b*, 78*c*, 78*d*, 78*e* transition from the circular cross-sectional shape to a polygonal shape with a flat, which enables the hot core passage 62 to have a high ratio of surface area to volume in the heat exchanging core, contributing to a high heat exchanging efficiency.

The highly efficient structure of this heat exchanger 2 reduces the importance of the thermal conductivity of the material used to construct the heat exchanger. Though extremely conductive materials would make the heat exchanger more efficient, the heat exchanger 2 would remain efficient even if constructed from a material of relatively poor conductivity.

Additive manufacturing techniques may be utilized to manufacture the heat exchanger 2. Additive manufacturing allows the build-up of very complex shapes by laying down material in layers to form a uniform, unitary structure that is integrally formed. This is shown schematically at 112 in FIG. 7. A lattice 108 comprised by an unfinished heat exchanger is being formed by an additive manufacturing tool 100 placing down material 104 layers.

The material 104 could be any substance suitable for additive manufacturing. The material 104 is provided in powder form, for example, and laser sintered to provide the unitary three-dimensional structure. In an example, the material 104 comprises titanium. In another example, the material 104 comprises aluminum. In another example, the material 104 comprises molybdenum. It should be noted that the thermal performance of this concept is largely independent of material type because all heat transfer is through primary surface area (hot and cold fluids separated by a thin wall). This allows the designer to use a high strength material such as titanium or inconel while seeing the same thermal performance as would be provided with high conductivity aluminum.

A heat exchanger having the features such as shown in FIGS. 1A through 7 would be difficult to make by traditional manufacturing techniques. However, utilizing additive manufacturing or precision casting techniques, the flow cross-sectional areas can be manufactured to specific designed shapes and areas. As a result, heat transfer enhancing features can be formed, such as serrated fins.

Although an embodiment of this invention has been disclosed, a worker of ordinary skill in this art would recognize that certain modifications would come within the scope of this invention. As an example, cold core passages 54 and hot core passages 58 could be modified to follow relatively complex or jagged paths. As another example, cold core passages 54 and hot core passages 58 could have relatively complex or jagged cross-sectional shapes. For that reason, the following claims should be studied to determine the true scope and content of this invention.

Any type of additive manufacturing process may be utilized. A worker of ordinary skill in the art would be able to select an appropriate known additive manufacturing process based upon the goals of this disclosure.

Thus, utilizing suitable manufacturing techniques, a worker of ordinary skill in the art would be able to achieve specific arrangements of interspersed flow passages as desired for a particular heat exchanger application.

The invention claimed is:

1. A heat exchanger comprising:

first fluid passages each having a first inlet that communicates into a first core passage, and then a first outlet, the first inlet having a first inlet cross-sectional perimeter, the first core passage having a first core cross-sectional perimeter;

second fluid passages interleaved with the first fluid passages, each of the second passages having a second inlet that communicates into a second core passage, and then a second outlet, the second inlet having a second inlet cross-sectional perimeter, the second core passage having a second core cross-sectional perimeter; and wherein the first and second core cross-sectional perimeters are larger than their respective first and second inlet cross-sectional perimeters, and the first and second core passages are undivided from their respective first and second inlets to their respective first and second outlets, wherein each first inlet has a first inlet cross-sectional area and each first core passage has a first core cross-sectional area, and the first core cross-sectional areas are smaller than their respective first inlet cross-sectional area.

2. The heat exchanger of claim 1, comprising:

first inlet manifolds communicating into the first inlets and first outlet manifolds communicated into by the second outlets;

second inlet manifolds communicating into the second inlets and second outlet manifolds communicated into by the second outlets;

wherein the first inlet manifolds, first outlet manifolds, second inlet manifolds, and second outlet manifolds extend in a first direction, and the first fluid passages and second fluid passages extend in a second direction transverse to the first direction.

3. The heat exchanger of claim 2, wherein an additively manufactured structure provides the first and second inlet and outlet manifolds and the first and second passages.

4. The heat exchanger of claim 1, wherein the first and second inlet and outlet manifolds extend in a first direction and the first and second fluid passages extend in a second direction transverse to the first direction.

5. The heat exchanger of claim 1, wherein a wall separates adjacent first and second core passages, wherein the wall has a generally uniform thickness.

6. The heat exchanger of claim 5, wherein the first core passages have a polygonal cross sectional shape with a flat, the flats of adjacent first fluid passages providing the wall.

7. A heat exchanger comprising:

first and second inlet and outlet manifolds;

first fluid passages fluidly interconnecting the first inlet and outlet manifolds, each of the first fluid passages having a first inlet at the first inlet manifold that communicates into a first core passage, and then a first outlet at the first outlet manifold, the first inlet having a first inlet cross-sectional perimeter, the first core passage having a first core cross-sectional perimeter;

second fluid passages fluidly interconnecting the second inlet and outlet manifolds, the second fluid passages interleaved with the first fluid passages, each of the second passages having a second inlet at the second inlet manifold that communicates into a second core passage, and then a second outlet at the second outlet manifold, the second inlet having a second inlet cross-sectional perimeter, the second core passage having a second core cross-sectional perimeter; and the first and second core cross-sectional perimeters are larger than their respective first and second inlet cross-sectional perimeters, wherein the first core passages have a polygonal cross sectional shape with a flat, the flats of adjacent first fluid passages providing the wall, wherein a first aspect ratio of the polygonal cross sectional shape changes progressively from the first and second inlet manifolds along a first portion of their respective first and second passages, and a second aspect ratio of the polygonal cross sectional shape changes progressively along a second portion of the first and second passages to their respective first and second outlet manifold portions, the first and second aspect ratios providing a smooth transition between the first and second inlet and outlet manifolds and the first and second passages.

8. The heat exchanger of claim 7, wherein each first inlet has a first inlet cross-sectional area and each first core passage has a first core cross-sectional area, and the first core cross-sectional areas are smaller than their respective first inlet cross-sectional area.

9. The heat exchanger of claim 7, wherein a wall separates adjacent first and second core passages, wherein the wall has a generally uniform thickness.

10. A method of manufacturing a heat exchanger according to claim 7, comprising the step of building up with a plurality of layers a structure having a wall separating adjacent first and second core passages, wherein the wall has a generally uniform thickness.

11. The method of claim 10, wherein the first and second directions are generally normal to one another.

* * * * *